US006135033A

United States Patent [19]

Deferrari

[11] Patent Number: 6,135,033

[45] Date of Patent: Oct. 24, 2000

[54] TRIANGULATED SHELF DISPLAY UNIT

[75] Inventor: Pablo Abel Deferrari, Freehold, N.J.

[73] Assignee: Chesapeake Corporation, Richmond, Va.

[21] Appl. No.: 09/327,712

[22] Filed: Jun. 8, 1999

[51] Int. Cl.[7] ..... A47B 3/00

[52] U.S. Cl. ..... 108/165; 108/180; 211/135

[58] Field of Search ..... 108/180, 165, 108/51.3, 106, 107, 110; 312/259; 248/174; 211/149, 135

[56] References Cited

U.S. PATENT DOCUMENTS

| | | | |
|---|---|---|---|
| 1,303,850 | 5/1919 | Bullock et al. | 108/110 |
| 1,764,131 | 6/1930 | Walter | 108/110 |
| 2,808,944 | 10/1957 | Jones et al. | 108/107 |
| 3,683,822 | 8/1972 | Roberts et al. | 108/51.3 |
| 3,729,244 | 4/1973 | Butler | 312/259 X |
| 3,987,737 | 10/1976 | Smith . | |
| 4,311,100 | 1/1982 | Gardner et al. | 211/149 X |
| 4,493,424 | 1/1985 | Smith . | |
| 4,506,790 | 3/1985 | Muscari . | |
| 4,519,319 | 5/1985 | Howlett . | |
| 5,183,166 | 2/1993 | Belokin et al. . | |
| 5,213,220 | 5/1993 | McBride . | |
| 5,322,172 | 6/1994 | Maglione . | |
| 5,365,857 | 11/1994 | Kilpatrick et al. | 108/51.3 |
| 5,632,390 | 5/1997 | Podergois | 211/149 X |
| 5,735,221 | 4/1998 | Benayon | 211/135 X |
| 5,826,732 | 10/1998 | Ragsdale . | |

*Primary Examiner*—Jose V. Chen
*Attorney, Agent, or Firm*—Hunton & Williams

[57] ABSTRACT

A triangulated shelf display unit comprises first and second support columns including a plurality of receptacles for receipt of respective ends of shelving units. The shelves are formed by folding along crease lines a rectangular piece of cardboard stock. Once folded, the shelves include a pair of triangulated beams positioned beneath a major planar surface of the shelf and located along side edges thereof. The triangulated beams provide increased structural rigidity and loading support to the display unit.

20 Claims, 10 Drawing Sheets

TRIANGULATED SHELF DISPLAY UNIT

FIELD OF THE INVENTION

This invention relates to the field of shelf display units and more particularly to a triangulated, collapsible, corrugated paper board shelf display unit used, for example, in point-of-sale transactions.

BACKGROUND OF THE INVENTION

The practice of displaying goods for sale within a rigid and highly decorative container has been increasingly employed, especially at outlet stores and discount supermarkets, as well as at various rental and sales locations for videotapes and books. These paper board containers allow the vendor to display merchandise without having to construct additional fixed shelving structures. These portable cardboard shelving structures are quickly assembled and are generally inexpensively manufactured so that they may be disposable.

Oftentimes, such display units are constructed from a single, dye-cut sheet of paper board and, through a variety of folding steps, the collapsible display unit is transformed into a structure containing at least one shelf for holding merchandise. One of the significant drawbacks of such structures is the inability to support a substantial amount of weight. This is due in part to the cantilevered structure of many of the foldable shelving units disclosed in the prior art. However, even where the shelves of prior displays extend between a pair of end supports, the shelves are typically formed from a single sheet of reinforced corrugated paper board which, though sufficient for display of lighter weight articles, are incapable of supporting substantial weights on the order of above 100 pounds.

These and other drawbacks of prior art foldable display assemblies are overcome by the invention of the preferred embodiments.

SUMMARY OF THE INVENTION

It is an object of the preferred embodiments to provide a foldable display assembly which includes substantial structural integrity and may withstand considerably more loading than prior art foldable display assemblies.

It is a further object of the preferred embodiments to provide a knock-down paperboard display assembly which is easily assembled on site.

It is a further object of the preferred embodiment to provide a corrugated paperboard assembly which is inexpensively manufactured.

These and other objects of the preferred embodiments are particularly achieved by a collapsible, corrugated paperboard assembly comprising first and second support columns. Each of these support columns includes at least one and preferably a plurality of receptacles for receipt, respectively, of first and second ends of a plurality of shelves. The support columns are preferably rectangular, hollow structures which fold substantially flat for shipping and transportation purposes.

A plurality of shelves extend between the support columns. The shelves include a major planer surface which is designed for merchandise support. The shelves have least one stiffening member operatively associated with the shelf. The stiffening member of the preferred embodiments comprises a pair of spaced parallel triangulated beams which extend along lateral end edges of the planar surface. Two sets of folds or creases are positioned at opposing sides of the paperboard stock. The paperboard stock is folded along these creases to form the triangulated beams. The receptacles formed in the support columns have profiles which substantially correspond to the cross-section of the triangulated shelf.

In one preferred embodiment, the foldable display assembly includes a rear wall. The rear wall is preferably formed by an extension integrally formed from one of the first or second support columns. At least one, and preferably more than one, tab are provided at a distal end of the rear wall extension. The tab is adapted to engage a slot formed in the other support column.

These and other features, objects and advantages of the preferred embodiments will become apparent when the detailed description of the preferred embodiments are read in conjunction with the drawing figures attached hereto.

BRIEF DESCRIPTION OF THE DRAWING FIGURES

FIGS. 11(*a*)–(*d*) illustrates a folding sequence for an internal support assembly employed in connection with a third preferred embodiment of the invention.

Figure 12:
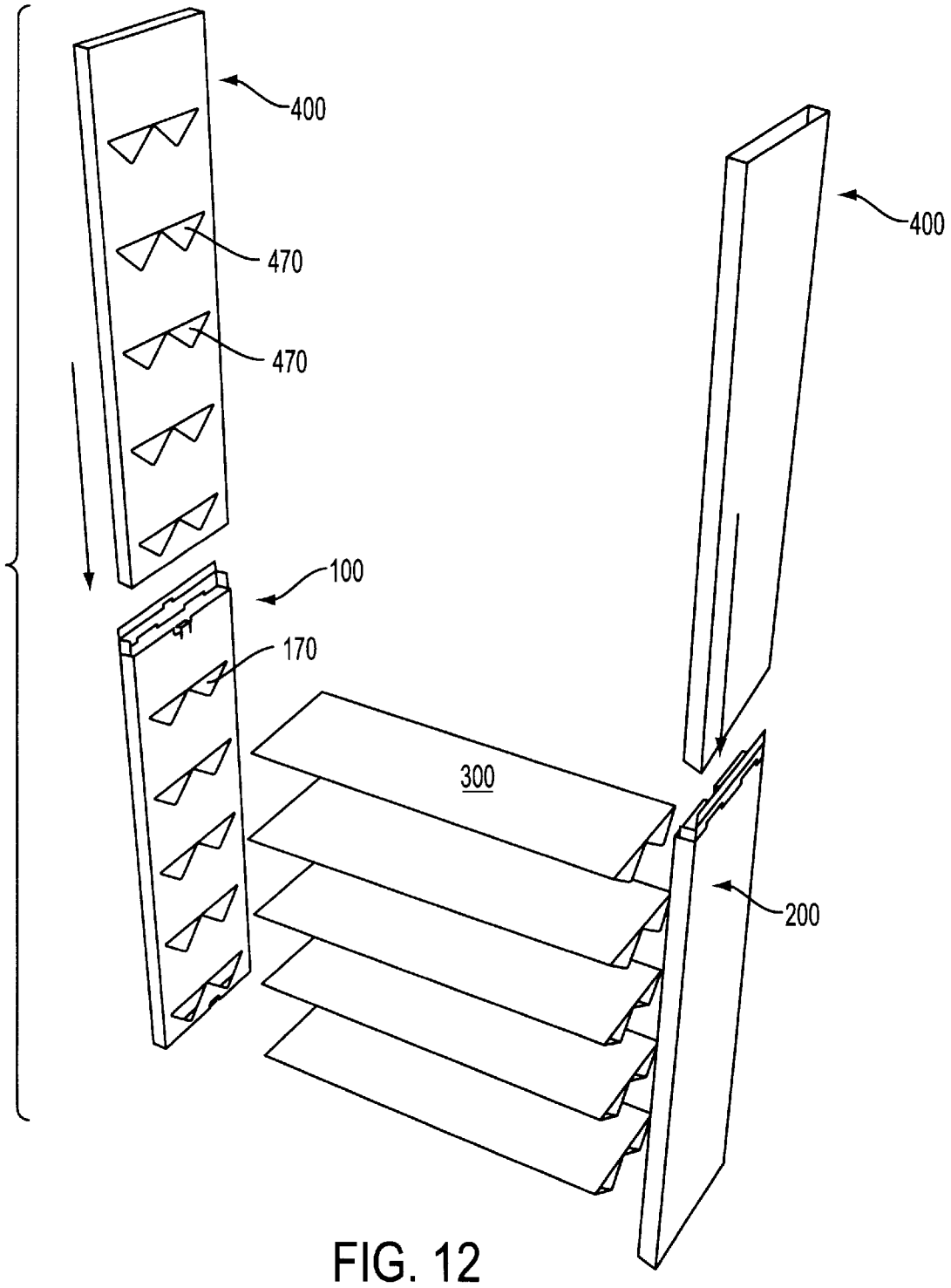

FIG. 12 illustrates an exploded view of the alternative triangulated shelf display unit according to the third preferred embodiment.

DETAILED DESCRIPTION OF THE PREFERRED EMBODIMENTS

Figure 1:
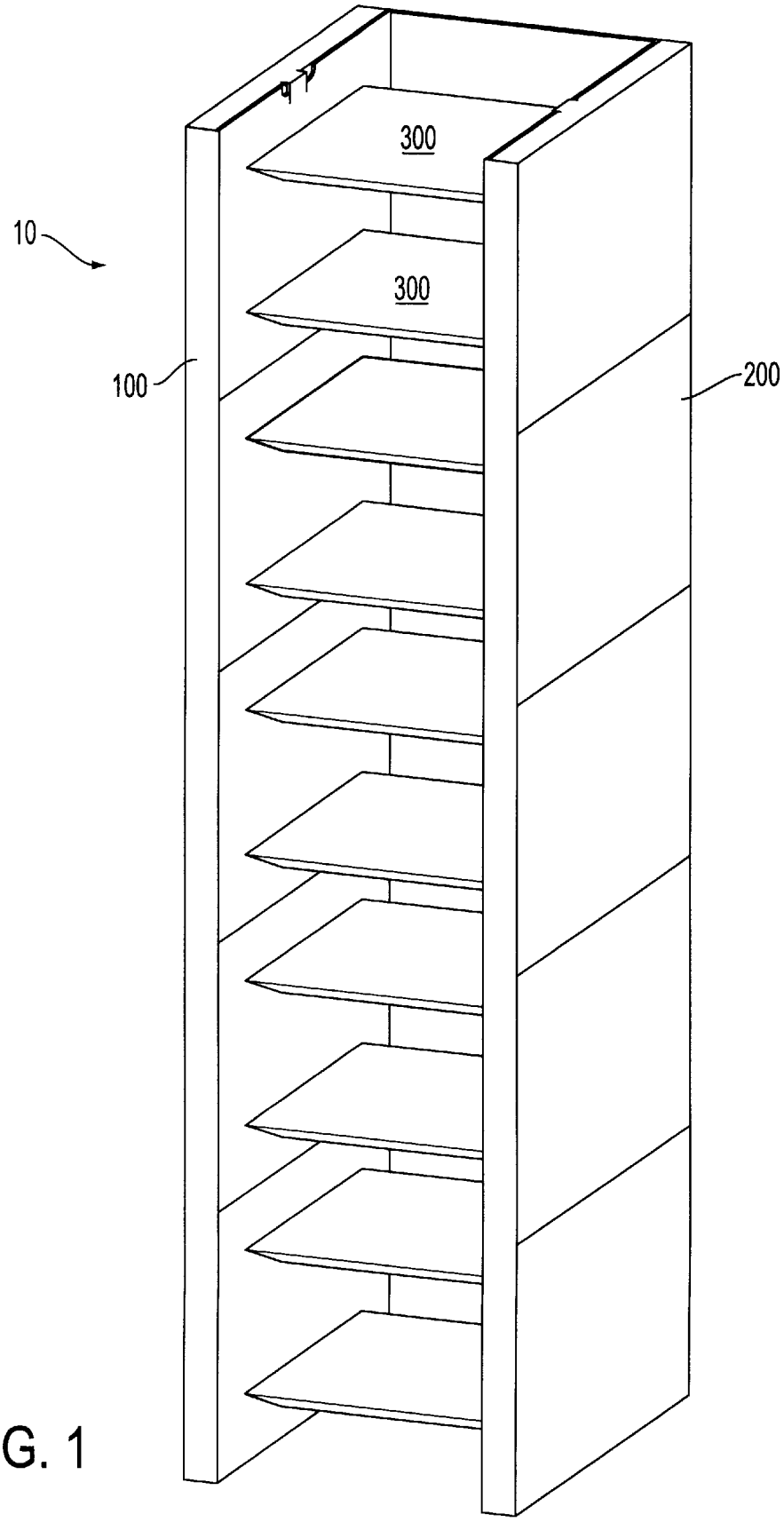
FIG. 1 is a isometric illustration of the triangulated shelf display unit, completely assembled, according to a first preferred embodiment of the invention.
Figure 2:
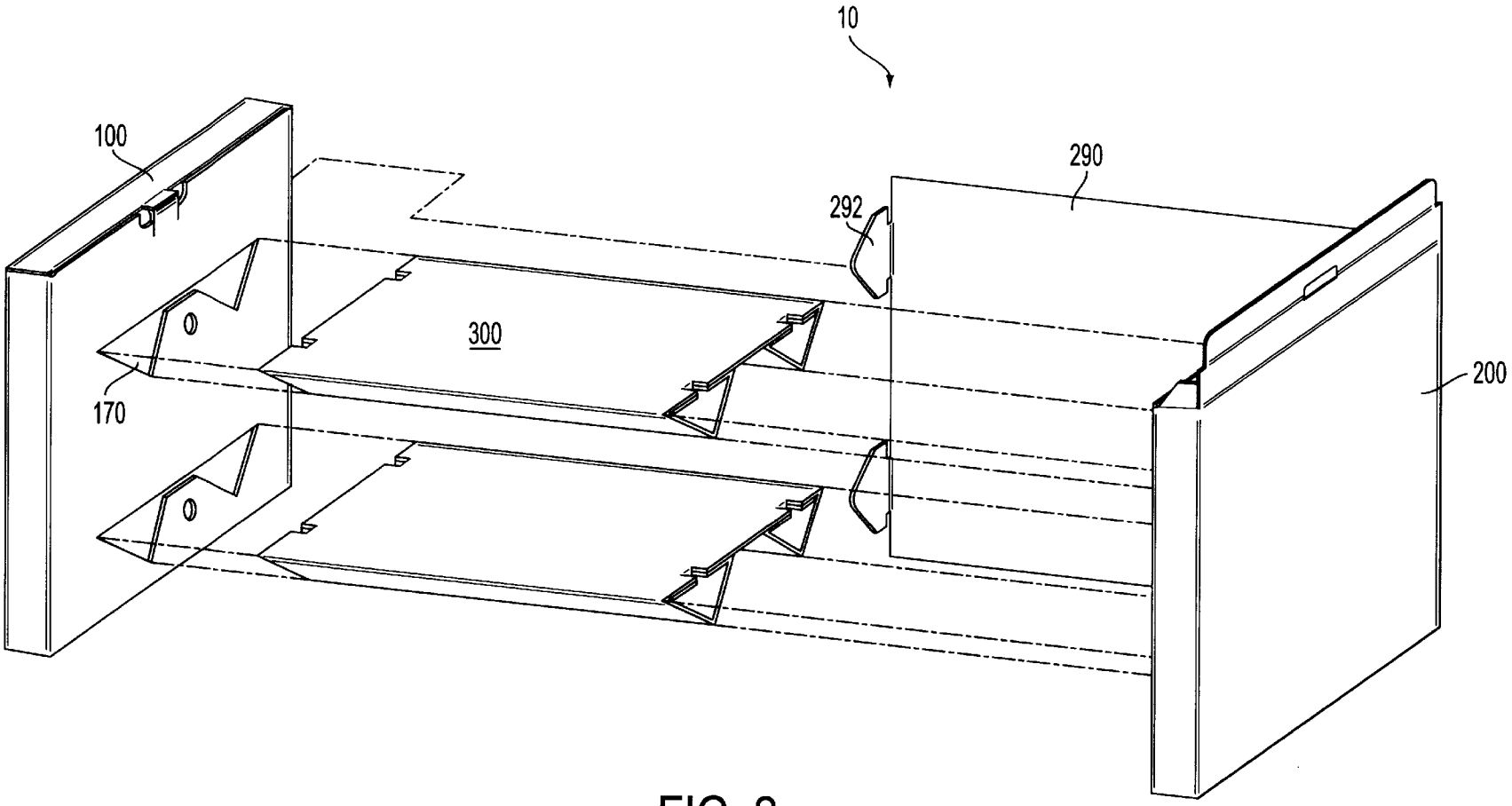
FIG. 2 is an exploded assembly view of the shelf display unit according to the first preferred embodiment.
Figure 4:
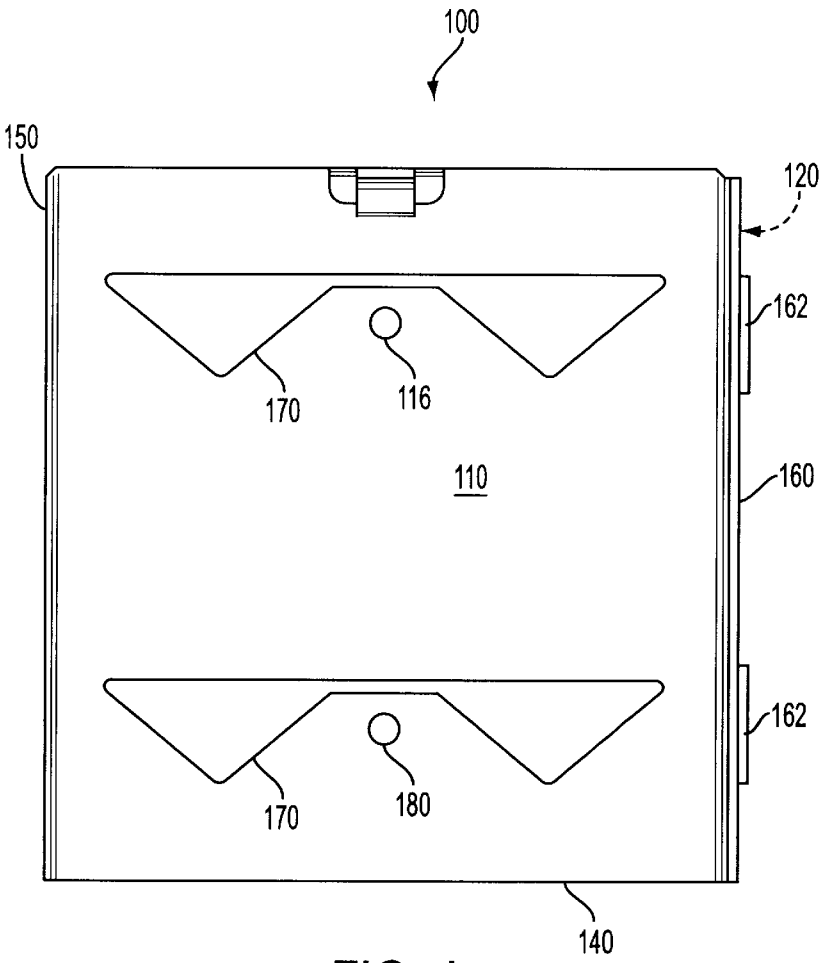
FIG. 4 is a plan view of the support column of FIG. 3 as assembled.

With reference to the drawing figures generally, and particularly to FIGS. 1 and 2, the triangulated shelf display unit 10 is principally comprised of three major elements, namely, first support column 100, second support column 200, and triangulated shelves 300. The first support column 100 as seen more particularly in FIGS. 3 and 4, comprises inner 110 and outer 120 walls, top 130 and bottom 140 walls, and front 150 and rear 160 walls. The first support column 100 includes at least one, and preferably a plurality of, receptacles 170 having a profile approximating a pair of spaced triangles. The receptacles 170 are prepared by dye-cutting the flat, cardboard stock from which the first support column 100 is constructed. The receptacles 170 are formed on the inner wall 110 of the first support column 100. Finger holes 116 are also dye-cut in the inner wall 110 of the first support column 110 beneath the receptacles 170.

The front 150 and rear 160 walls include a pair of tabs 180 extending above the upper surface 112 of the inner wall 110. The inner wall 110 likewise includes a tab 114 extending above the upper surface of the inner wall 110. The outer wall 120 includes a cover flap 122 which is an extension of the outer wall 120. The cover flap 122 includes a slot 124 which is adapted to engage the tab 114 which is connected to the inner wall 110.

A pair of slots 162 are provided on the rear wall 160. Slots 162 are adapted to engage a pair of corresponding tabs 292 formed on wall 290 (FIG. 5, discussed below) which is integrally formed on the second support column 200.

Figure 3:
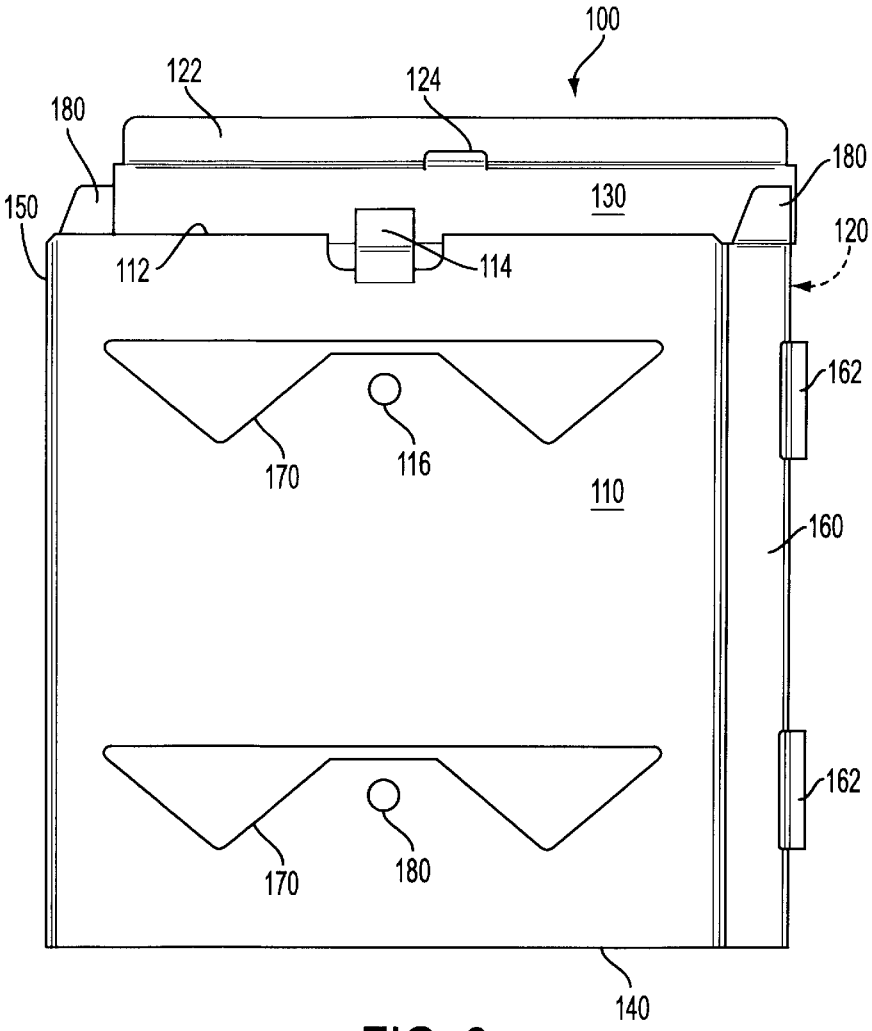
FIG. 3 is a plan view of one of the support columns as shown in its collapsed or knock-down configuration.

As shown in FIG. 3, the first support column 100 may be folded upon itself in a knock-down configuration. The first support column 100 is constructed by opening the structure so that the inner 110 and outer 120 walls are separated by a distance corresponding to the width of the front 150 and rear 160 walls. The tabs 180 on the front 150 and rear 160 walls are lowered, and the cover flap 122 is brought into engagement with the inner wall 110 so that the tab 114 on the inner wall engages the slot 124.

Figure 5:
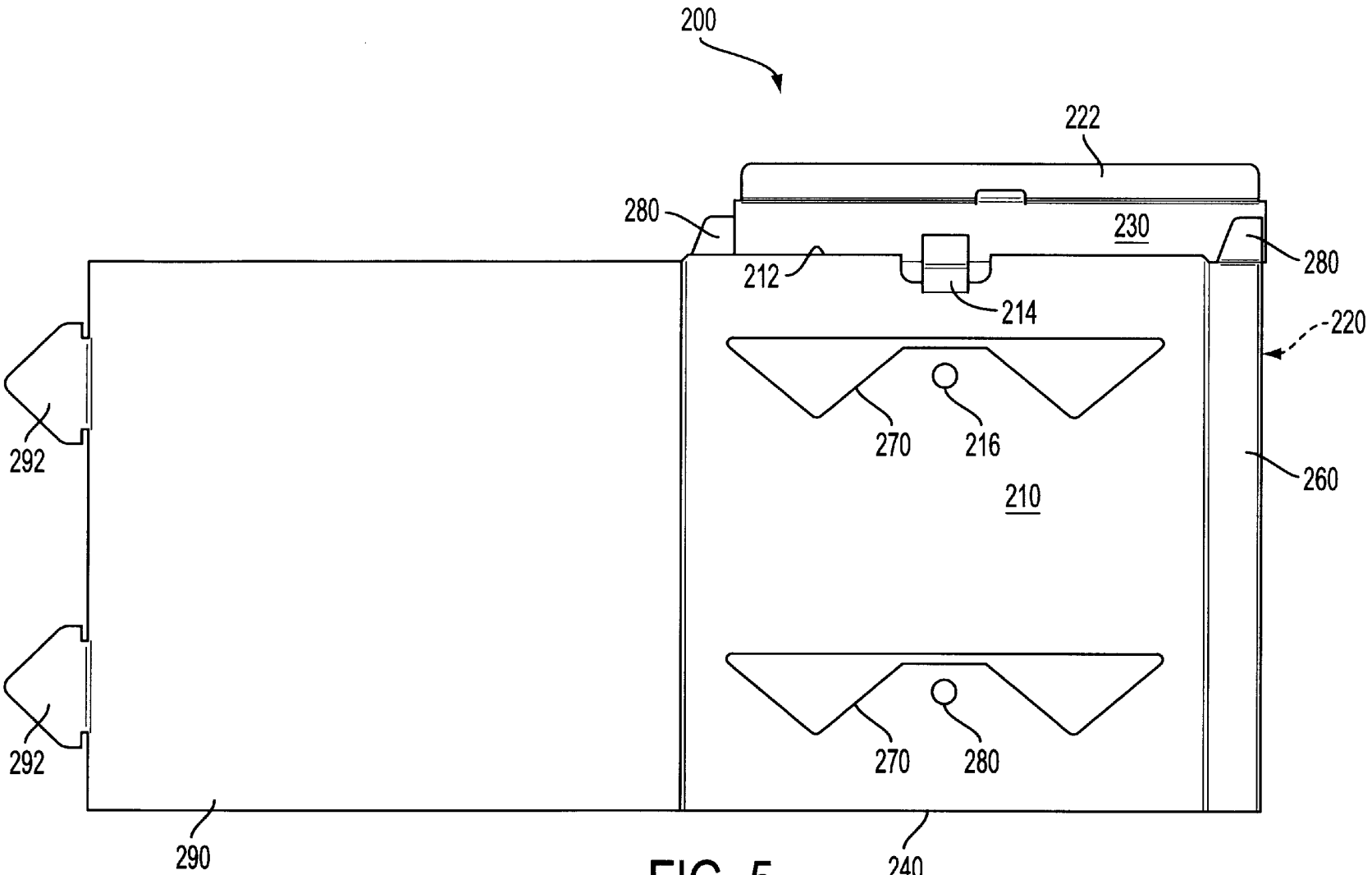
FIG. 5 is a plan view of the other support column and its associated integral rear wall illustrated in the collapsed or knock-down configuration.

With reference to FIG. 5, there is depicted one preferred embodiment of the second support column 200. The second support column 200 is similar in several respects to the first support column 100, with the principle difference being the wall 290 which is integrally formed from and extending from the rear wall 220. Like the first support column 100, the second support column 200 includes at least one, and preferably a plurality of receptacles 270 dye-cut from the stock used to form the second support column 200. The receptacles 270 are formed on the inner wall. Finger holes 216 are positioned beneath receptacles 270. Tabs 280 are also provided.

The wall 290 is illustrated as being substantially rectangular, but it is within the scope of the preferred embodiments to utilize different configurations. The wall 290 includes at least one and preferably a plurality of tab projections 292 extending from the distal end thereof. The tab projections 292 are adapted to be received in the slots 162 (FIG. 3) upon assembly of the triangulated shelf display unit 10.

Figure 6:
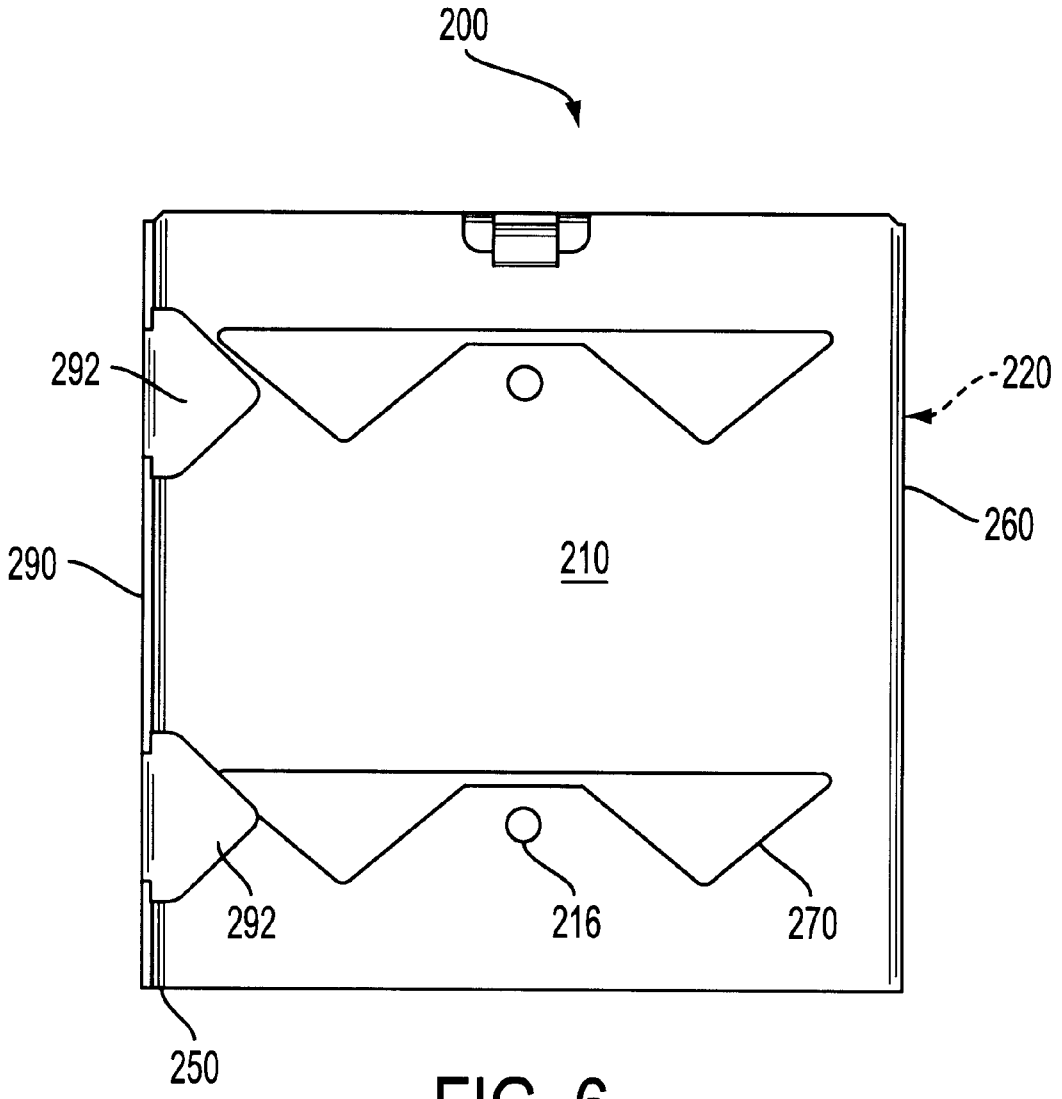
FIG. 6 is a side view of the support wall of FIG. 5 as assembled prior to attachment of the shelving units and support column of FIGS. 3 and 4.

As illustrated in FIG. 6, the second support column 200 may be assembled in a manner similar to the first support column 100. Namely, the inner 210 and outer 220 walls are separated by a distance corresponding to the width of the front 250 and rear 260 walls. The wall 290 is brought to a position where it is substantially extending at a right angle to the inner wall 210 of the second support column 200. The tab projections 292 on wall 290 are creased at the point of attachment with wall 290 so that they are positioned substantially at right angles with the plane of the rear wall.

Figure 7:
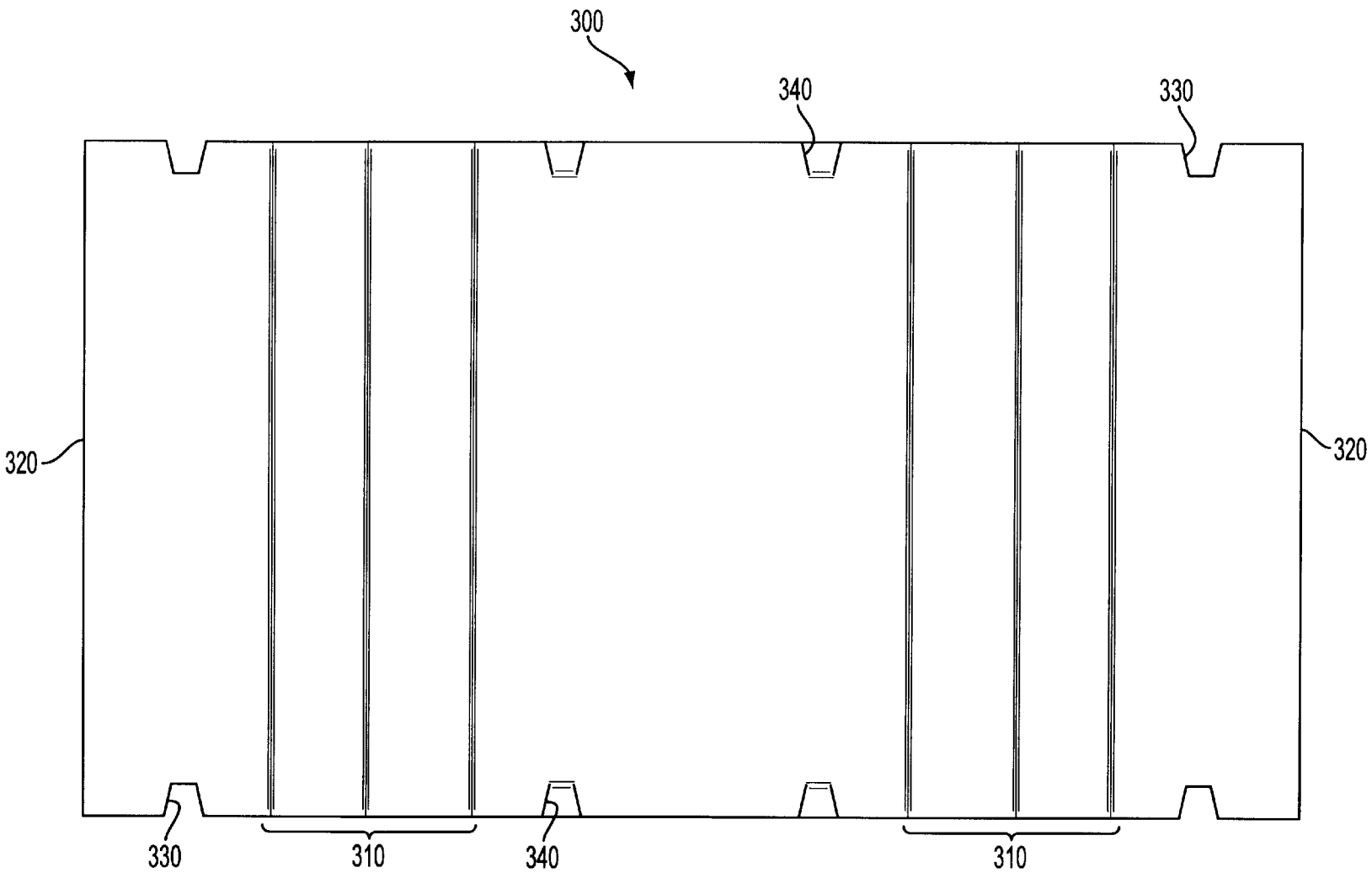
FIG. 7 is a plan view of the paperboard stock which, when folded, forms a triangulated shelf.
Figure 8:
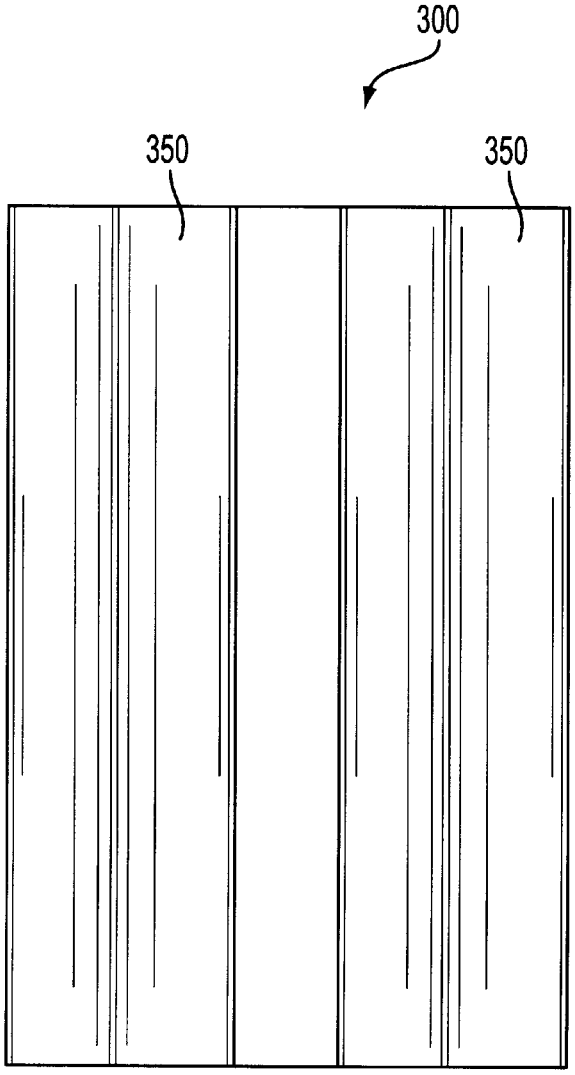
FIG. 8 is a bottom plane view of the triangulated shelf assembly as folded.
Figure 9:
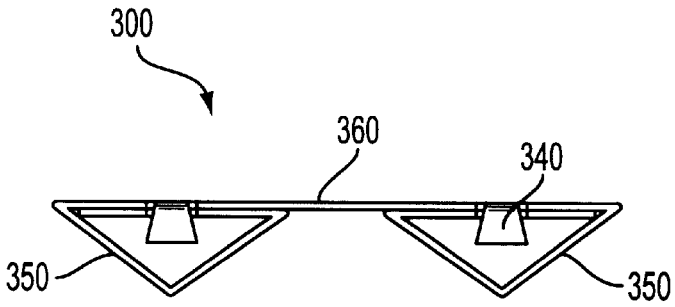
FIG. 9 is a side view of the triangulated shelf assembly of FIG. 8.

With reference now to FIG. 7, there is illustrated a raw material stock from which the shelves 300 have been die-cut. The stock has two sets of three creases 310 spaced from the side edges 320 thereof. The stock may be provided with slots 330 and tabs 340 which, as seen in FIG. 9, serve to engage and lock the shelving unit when in the folded configuration. Specifically, the shelf 300 is formed by folding the stock along the creases 310. A shelf is thereby formed, which includes a pair of spaced triangulated beams 350 positioned beneath an upper planar major surface 360. Merchandise may be placed on surface 360. The profile of the folded shelf assembly, as seen in FIG. 9, corresponds substantially to the receptacles 170, 270 in the inner walls 110, 210 of the first 100 and second 200 support columns.

The triangulated shelf display unit 10 is constructed, as shown in FIG. 2, by first assembling the individual components comprising the first 100 and second 200 support columns and the individual shelf units 300. Then, the shelf units 300 are inserted into respective corresponding receptacles 170, 270 in the first 100 and second 200 columns, while the wall 290 may be rotated so that the projection tabs 292 are inserted into the slots 162 formed in the rear wall 160 of the first support column 100.

Figure 10:
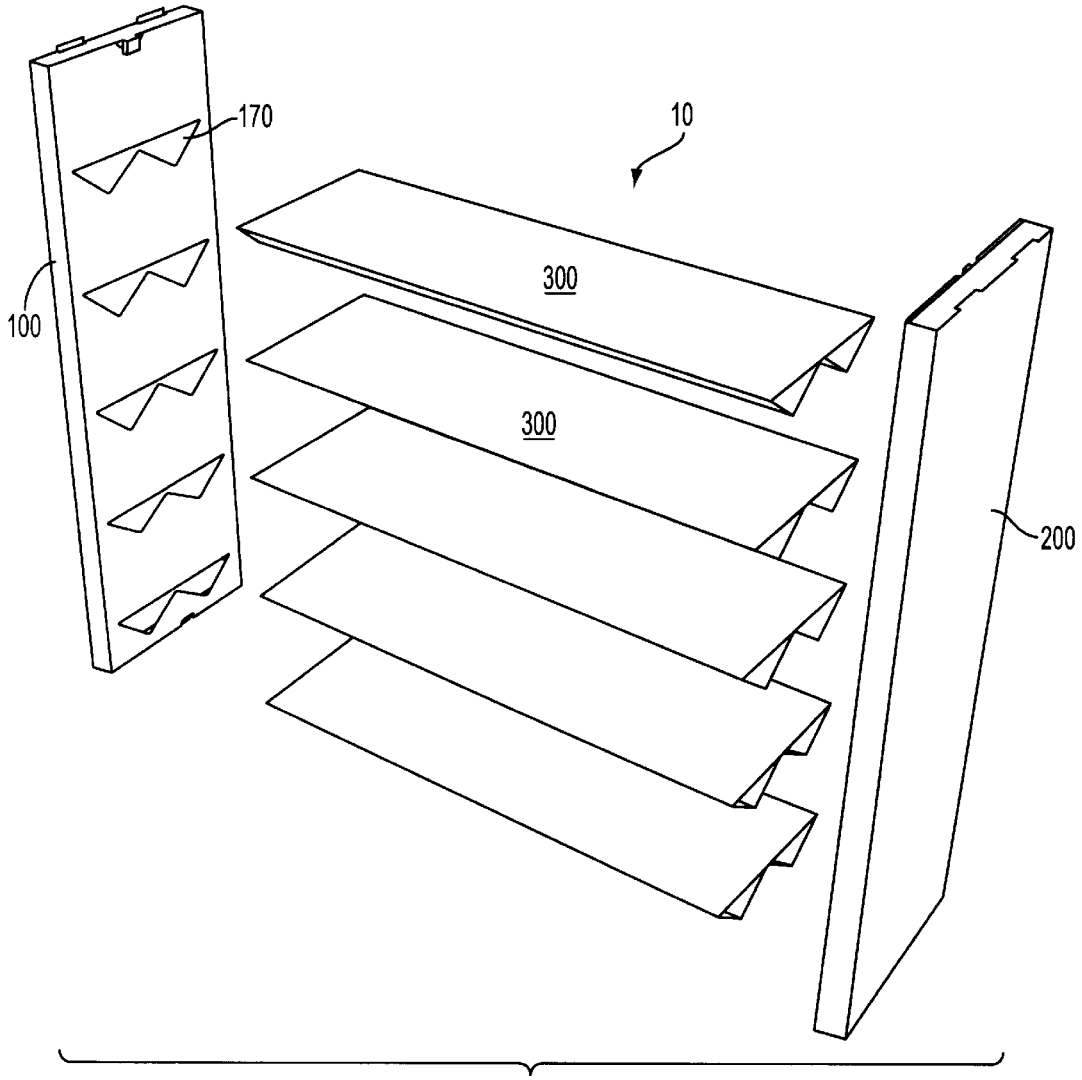
FIG. 10 is an alternative triangulated shelf display unit according to a second preferred embodiment.
Figure 11B:
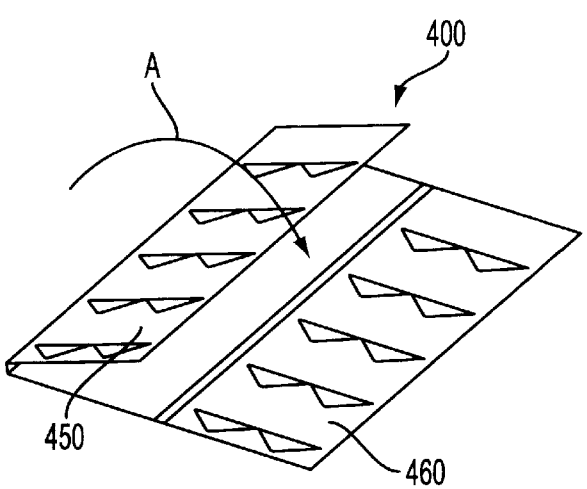
Figure 11A:
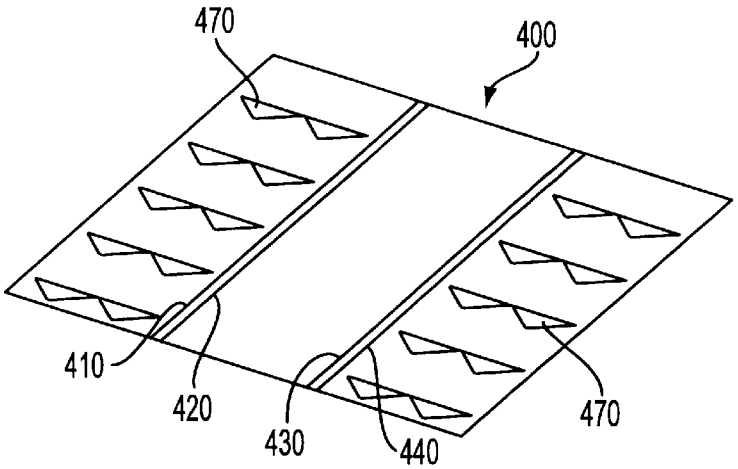
Figure 11D:
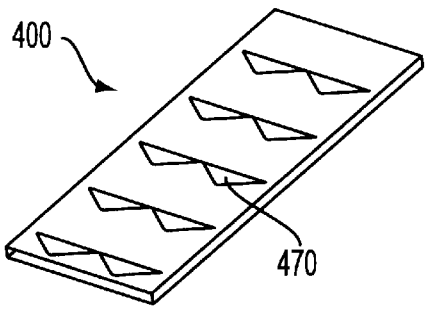
Figure 11C:
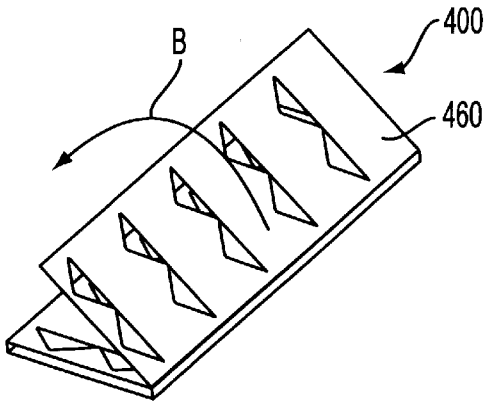

A second preferred embodiment of the invention is depicted in FIG. 10. In this embodiment, wall 290 has been omitted. This configuration is particularly preferred where the shelf display unit is itself positioned against a wall so that merchandise positioned thereon will not fall off the back end thereof. Alternatively, this configuration is also preferred where the retailer desires that the merchandise may be accessed from two sides of the shelf display unit 10.

With reference to FIGS. 11(*a*)–(*d*), there is illustrated a third preferred embodiment of the triangulated shelf display unit. FIGS. 11(*a*)–(*c*) illustrate cardboard stock which is used as an internal support assembly 400 to provide additional structural rigidity to the first and second support columns 100, 200. The internal support assembly 400 includes a plurality of receptacles 470 which substantially correspond in shape, size and location to receptacles 170, 270 on first and second support columns 100, 200. Internal support assembly 400 furthermore includes a plurality of creases 410, 420, 430, 440 along which the cardboard stock is folded to create the internal support assembly 400. As shown in FIG. 11(*b*), first wall 450 is folded inwardly towards second wall 460 along creases 410, 420 illustrated by arrow A. Then, as shown in FIG. 11(*c*), second wall 460 is folded along creases 430, 440 in the direction of first wall 450 (along arrow B) so that as shown in FIG. 11(*d*), first and second walls 450, 460 are brought into registration with one another, and receptacles 470 are aligned.

After the internal support assembly is constructed as shown in FIG. 11(*d*), the internal supports may be inserted into first and second support columns 100, 200 as illustrated in FIG. 12. It will be readily appreciated that the internal supports 400 are sized to have outer dimensions when folded as illustrated in FIG. 11(*d*) to be slightly smaller than the internal dimensions of the first and second support columns 100, 200, when folded. This sizing allows the internal supports 400 to fit snugly inside of first and second support columns 100, 200. Once inside first and second support columns 100, 200, the receptacles 470 of internal supports 400 are brought into registration and alignment with the receptacles 170, 270 of first and second support columns 100, 200, respectively.

It has been discovered that the pair of triangulated beams 350 in the shelving units 300 provides significantly improved structural rigidity to the shelf display unit. Namely, the triangulated beams 350 allow for substantially heavier merchandise to be supported where traditional plastic or metal display support units were required. In this regard, the shelf was tested, the results of which are tabulated below:

TABLE 1

Material and Weight Tolerances for 48" × 16" Triangulated Shelf Display Unit

| BOARD GRADE | EDGE CRUSH TEST MINIMUM (ECT) (lbs. per in. width) | MAXIMUM WEIGHT (lbs.) |
|---|---|---|
| Singlewall B 200 | 32 | 180 |
| Singlewall C 200 | 32 | 225 |
| Singlewall C 275 | 44 | 285 |

All weights and material specifications are for the same 48" × 16" shelf.

The shelves were tested for maximum loading. Each was folded along crease lines 310 such that the major planar surface 360 had a depth of 16 inches and a width of 48 inches. Three board grades were tested.

For the single wall B-fluted grade 200 board, the triangulated shelf supported, without failure, 180 pounds of merchandise, which was evenly distributed throughout the major planar surface 360 of the shelf. With C-fluted cardboard, the shelf withstood a loading of 225 pounds. With 275 C-fluted stock, the triangulated shelf withstood 285-lbs. of loading without failure. These loadings are believed to be a significant improvement over conventional cardboard display units disclosed in the prior art. It is believed that the triangulated beams 350 provide a measure of structural rigidity which is not obtainable by single, double or even triple wall cardboard panel of similar dimensions.

Although the invention has been described principally in connection with first 100 and second 200 columns having only a pair of receptacles 170, 270, it is within the scope of the preferred embodiments to provide several more receptacles along the length of the inner walls to accommodate as many shelves as are necessary for the particular display application.

This invention has been described in connection with the preferred embodiments. These embodiments are intended to be illustrative only. It will be readily appreciated by those skilled in the art that modifications may be made to these preferred embodiments without departing from the scope of the invention as defined by the appended claims.

I claim:

1. A collapsible corrugated paperboard apparatus for displaying merchandise for point of sale transactions comprising:

a first support column having an inner wall comprising a plurality of receptacles for receipt respectively of first ends of a plurality of shelves;

a second support column spaced from said first support column and having an inner wall comprising a plurality of receptacles for receipt respectively of second ends of the plurality of shelves; wherein at least one of said plurality of shelves comprises:

a planar surface for merchandise support; and at least one stiffening member operatively associated with said at least one shelf, said stiffening member and said planar surface having a cross-sectional shape corresponding substantially with at least one of said receptacles located on the inner wall of the first support column and with at least one of said receptacles located on the inner wall of the second support column.

2. The collapsible apparatus of claim 1 further comprising a pair of stiffening members operatively associated with each shelf.

3. The collapsible apparatus of claim 2, said stiffening members comprising a pair of triangulated supporting beams extending in parallel substantially entirely across the length of said shelves.

4. The collapsible apparatus of claim 3, said supporting beams positioned on respective side edges of said planar surface.

5. The collapsible apparatus of claim 3, said supporting beams positioned beneath said planar surface upon assembly of the apparatus.

6. The collapsible apparatus of claim 3, said supporting beams formed by folding said shelves along crease lines.

7. The collapsible apparatus of claim 1, further comprising a rear wall positioned behind said plurality of shelves, said rear wall comprising a planar extension of said second support column, said rear wall including at least one tab at a distal end thereof, said tab adapted to engage a slot formed in said first support column.

8. The collapsible apparatus of claim 1, said support columns, when assembled, being substantially rectangular with a hollow interior.

9. The collapsible apparatus of claim 1, further comprising internal supports disposed within at least one of said first and second support columns.

10. The collapsible apparatus of claim 9, said internal supports disposed within both of said first and second support columns.

11. The collapsible apparatus of claim 9, said internal supports including a plurality of receptacles positioned for registration with said plurality of receptacles in said first and second support columns.

12. A knock-down, paperboard shelving assembly comprising:

a first support column;

a second support column spaced from said first support column;

a plurality of shelves extending between said first and second support columns, each of said shelves comprising a pair of longitudinally extending triangulated be, and;

a plurality of receptacles in the first and second support columns for receiving the plurality of shelves, the receptacles comprising two triangular apertures to accommodate the shelves having triangulated beams.

13. The assembly of claim 12, wherein each of said shelves is formed from a single piece of cardboard stock having three crease lines along each of respective side edges thereof, said triangulated beams being formed by folding the respective side edges of said cardboard stock along the crease lines.

14. The assembly of claim 12, said first and second support columns including receptacles shaped to receive respective ends of the plurality of shelves.

15. The assembly of claim 12, further comprising a rear wall integrally formed and extending from one of the support columns.

16. The assembly of claim 12, said support columns being substantially rectangular when assembled, said support columns having hollow interiors.

17. The collapsible apparatus of claim 12, further comprising internal supports disposed within at least one of said first and second support columns.

18. The collapsible apparatus of claim 17, said internal supports disposed within both of said first and second support columns.

19. The collapsible apparatus of claim 18, said internal supports including a plurality of receptacles positioned for registration with a plurality of receptacles in said first and second support columns.

20. A knock-down, paperboard shelving assembly comprising:

a first support column comprising a plurality of receptacles along an inner wall;

a second support column comprising a plurality of receptacles along an inner wall;

first and second internal supports disposed within the first and second support columns respectively, the internal supports including a plurality of receptacles positioned for registration with the plurality of receptacles within the first and second support columns; and a plurality of shelves extending between the receptacles of the first and second support columns, the shelves comprising a planar portion and first and second stiffening members extending longitudinally along the planar portion, wherein the planar portion and the stiffening members have a cross-sectional shape that matingly engages with the plurality of receptacles in the first and second support columns and the internal supports.

* * * * *